US005423596A

United States Patent [19]

Laughlin et al.

[11] Patent Number: 5,423,596

[45] Date of Patent: Jun. 13, 1995

[54] MULTI-FUNCTIONAL UPHOLSTERED FURNITURE SYSTEM

[75] Inventors: Glenn M. Laughlin, High Point, N.C.; Jeffrey A. Frank, Arlington, Va.; Bruce Hirschhaut, High Point, N.C.

[73] Assignee: JBG Original Designs Incorporated, High Point, N.C.

[21] Appl. No.: 45,055

[22] Filed: Apr. 8, 1993

Related U.S. Application Data

[63] Continuation-in-part of Ser. No. 720,369, Jun. 25, 1991, Pat. No. 5,263,764.

[51] Int. Cl.[6] ..... A47C 7/00

[52] U.S. Cl. ..... 297/440.1; 297/452.18

[58] Field of Search ..... 297/440.1, 440.15, 440.18, 297/440.19, 440.2, 440.22, 452.18, 452.1, 445

[56] References Cited

U.S. PATENT DOCUMENTS

| | | | |
|---|---|---|---|
| 3,129,472 | 4/1964 | Hensel . | |
| 3,556,594 | 1/1971 | Anderson | 297/440.22 X |
| 3,658,382 | 4/1972 | Anderson . | |
| 3,695,690 | 10/1972 | Carson . | |
| 3,774,966 | 11/1973 | Faulkner et al. . | |
| 3,799,611 | 3/1974 | Steinfeld . | |
| 3,842,456 | 10/1974 | Bronstien, Jr. . | |
| 3,857,120 | 12/1974 | Acker | 297/440.20 X |
| 3,951,558 | 4/1976 | Komarov . | |
| 3,966,340 | 6/1976 | Morris . | |
| 3,989,300 | 11/1976 | Heumann | 297/440.20 X |
| 4,012,155 | 3/1977 | Morris . | |
| 4,025,216 | 5/1977 | Hives . | |
| 4,074,919 | 2/1978 | Watts | 297/440.1 X |
| 4,165,902 | 8/1979 | Ehrlich . | |
| 4,204,287 | 5/1980 | Lane et al. . | |
| 4,261,667 | 4/1981 | Ervin et al. . | |
| 4,292,003 | 9/1981 | Pond . | |
| 4,305,616 | 12/1981 | Martinez | 297/440.15 |
| 4,365,840 | 12/1982 | Kehl et al. . | |
| 4,668,011 | 5/1987 | Fister, Jr. . | |
| 4,711,495 | 12/1987 | Magder . | |
| 4,883,331 | 11/1989 | Mengel . | |
| 4,886,326 | 12/1989 | Kuzyk . | |
| 4,893,958 | 1/1990 | Wieland . | |
| 4,932,720 | 6/1990 | Sherman . | |
| 4,944,627 | 7/1990 | Durney . | |
| 5,007,681 | 4/1991 | Meier et al. | 297/440.22 |
| 5,069,506 | 12/1991 | Wieland . | |
| 5,135,284 | 8/1992 | Crum . | |
| 5,232,266 | 8/1993 | Mork | 297/490.22 X |
| 5,265,939 | 11/1993 | Self et al. . | |

FOREIGN PATENT DOCUMENTS

| | | | |
|---|---|---|---|
| 384180 | 10/1923 | Germany | 297/440.1 |
| 614340 | 5/1935 | Germany | 297/440.22 |
| 2900117 | 7/1979 | Germany | 297/440.15 |

OTHER PUBLICATIONS

Low Cavity Flotura 43795 Series, 1979.

*Primary Examiner*—Jose V. Chen

*Attorney, Agent, or Firm*—Spencer, Frank & Schneider

[57] ABSTRACT

An upholstered furniture system for mounting on a horizontal surface. The system comprises spaced apart vertical arm members, each having an inner surface including back and front portions. Side support members are affixed to the inner surfaces of the arm members for removably supporting a seat support member.

Support elements are affixed to the back portions of the inner surfaces of arm members and a back member is interposed between the spaced apart arm members. The back member includes an outer back part having spaced apart vertical outer back part side members supported by the support elements, and a horizontal outer back part top rail extending between the vertical outer back part side members. An inner back part is provided having spaced apart vertical inner back part side members, and a horizontal inner back part top rail extending between the vertical inner back part side members. A hinge connects the outer back part top rail to the inner back part top rail so as to permit rotation of the inner back part about a horizontal axis parallel to the outer and inner back part top rails. Support elements are affixed to the back portions of the inner surfaces of the. The rotation of the inner back part about the horizontal axis brings the inner back part into contact with the third and fourth support elements thereby adjustably limiting rotation of the inner back part. Fasteners are provided for removably fastening the back member to the arm members, and a front member is interposed between the spaced apart arm members.

22 Claims, 11 Drawing Sheets

90
87
26
76
94
102
92
48
100
42
84
83
114
103
98
49
57
22
63
53
85
55
104
71
74
72
70
66
67
52
62
56
69
54
46

MULTI-FUNCTIONAL UPHOLSTERED FURNITURE SYSTEM

This application is a continuation-in-part of application Ser. No. 07/720,369 filed June 25th, 1991, now U.S. Pat. No. 5,263,764.

BACKGROUND OF THE INVENTION

This invention relates to furniture, and in particular to furniture having interchangeable components.

In conventional upholstered furniture, such as chairs, love seats, sofas and sleepers, the standard method of construction utilizes a fully assembled wood or wood-product frame having a seat, a front rail and a back rail. The frame is covered by a non-removable fabric covering, and upholstery consisting of materials such as fiber and foam are attached to the fabric covering. Springs, webbing or other means of support are permanently attached below the seat to the front and back rails. The pitch of the seat is determined by the difference in height between the front and back rails.

It is also conventional to provide furniture having a sleeper mechanism and folding mattress permanently attached to a wood frame. However, conventional furniture designed to receive a sleeper mechanism requires a completely different size and design of frame than a non-sleeper sofa having the same appearance. The spring units used in conventional sofas and the sleeper mechanisms used in sleeper-type sofas are not interchangeable either before or after the upholstering process.

Back cushions used with both types of furniture, sleeper and non-sleeper, may be either "tight" (upholstered as part of the overall frame) or "loose" (individual cushions separate from the frame). In both types of furniture, once the frame has been completed only minimal modifications can be made in the shape and style of the upholstered piece. It cannot be altered once the fabric covering has been attached.

The design of conventional upholstered furniture imposes many limitations on the manufacturer, the retailer and the consumer. The manufacturer is faced with an industry that demands constant style changes, although such changes are difficult to make because there are few interchangeable parts among the many different styles and few styles are popular for more than two or three years. As a result, he is forced to periodically design and fabricate new components for each style. Frequent redesign of the product and retooling of production equipment imposes a heavy burden on the manufacturer in terms of both inventory control and maintaining manufacturing efficiency.

Another limitation on the manufacturer is that upholstered furniture tends to be large, bulky and heavy. Accordingly, shipping is expensive with the result that it is rarely cost-effective for a manufacturer of upholstered furniture to ship his products over long distances. Consequently, many manufacturers of upholstered furniture find that they must have several factories located in different parts of the country to reduce freight costs. The high cost of freight also accounts for the fact that few upholstered products produced in this country are exported overseas. In addition, cartons suitable for the shipping of furniture are quite expensive, and this has lead manufacturers to ship upholstered items in less protective plastic wraps thereby risking damage to their products.

The retailer of upholstered furniture also faces many problems. Since the product is bulky, expensive display and warehousing facilities must be provided. The typical customer is seeking a wide selection of styles, designs and sizes to choose from, and often demands immediate delivery once he has made his choice. It is difficult for a retailer to provide such service without huge inventory, warehouse and showroom costs.

Another problem faced by the retailer is that merchandise not sold in a relatively short time tends to become soiled or broken. Cleaning upholstered furniture is difficult and repairs usually require the services of a skilled technician. Both are expensive. Fast selling products can also create problems because reorders usually take six to twelve weeks, and this means the retailer may be without a best seller for an extended period of time.

Shopping for upholstered furniture can be a frustrating experience for the consumer. The typical retail purchaser is often unfamiliar with the brand names of upholstered furniture and there is no practical way he or she can check the quality of an item. Locating a suitable item may be difficult because some stores sell only sofas and chairs with few love seats, while others sell only sleepers. Even enormous warehouse showrooms cater only to the most popular tastes of the moment. Less popular sizes and styles are not stocked by most retailers.

The consumer must make a wide range of decisions before and after purchasing furniture. In the case of a sofa, consideration must be given to matching the sofa with existing room decor, and predictions must be made as to whether the sofa whose purchase is contemplated will harmonize with possible future decorating schemes. After the sofa has become worn, it may be covered with custom slip covers. However, such covers are usually expensive, clumsy and fit loosely thereby obscuring the tailored look of the original sofa design. Reupholstry costs are nearly the same as buying a new piece and, as explained above, even simple cleaning of an upholstered piece is difficult and best left to professionals. In addition, while the frame of a sofa or chair normally lasts far longer than the fabric or cushions, the current state of upholstered furniture technology does not permit cost-effective recycling of the furniture frame.

Still another limitation placed upon the consumer is that he or she must decide whether or not to buy a sofa of a type suitable for sleeping. Current upholstered furniture technology does not allow the installation of a sleeper mechanism and mattress in a sofa of the non-sleeper type.

There have been attempts to correct some of these design limitations. For example, the Faulkner et al. U.S. Pat. No. 3,774,966 discloses a knock-down sofa having replaceable parts. However, the sofa disclosed in this patent provides little flexibility in styling, employs a simple frame construction which is not easily adaptable to a large number of styles and designs, and cannot accommodate a sleeper mechanism.

There have also been attempts to improve the design of conventional upholstered furniture by making improvements in removable slip covers. Such covers have several advantages in that they can be removed for cleaning, replaced if damaged and changed when redecorating. For example, U.S. Pat. No. 3,248,147 to Testa discloses a removable slip cover that simulates a tailored appearance similar to conventional upholstered furniture. However, the upholstery assembly disclosed by Testa is relatively expensive because it uses both sub-upholstery and a removable cover over the sub-upholstery. The Testa chair cannot accommodate a sleeper mechanism and provides little flexibility in styling. The frame construction described in Testa is suitable only for chairs or sofas with substantially perpendicular arms. A curved arm recovered using Testa's method would appear to be straight.

SUMMARY OF THE INVENTION

The present invention provides an item of upholstered furniture which can accommodate either a removable spring platform or a sleeper mechanism and mattress, utilizes a knock-down frame with interchangeable parts and permits the fabric cover to be replaced easily and quickly. Thus, it is an object of our invention to provide an item of upholstered furniture having removable and interchangeable spring and sleeper units.

Another object of the invention is to provide an item of upholstered furniture having interchangeable parts which can be easily assembled and disassembled without tools.

A further object is to provide an upholstered furniture frame which allows the use of removable covers.

Still another object of the invention is to provide an item of upholstered furniture in which the back is hinged and adjustable to different angles.

Yet another object of the invention is to provide an item of upholstered furniture having a hinged back which allows access from either the front or the rear to means for assembling and disassembling the furniture, and which permits the back to be folded flat so that it requires minimum space for storage and shipment. It also allows the manufacturer to use a single piece of fabric to cover both the inner back and the outer back. Conventional upholstered furniture uses two pieces of fabric joined by tack strips, welts or other costly techniques.

A still further object is to provide an item of furniture having interchangeable spring and sleeper units wherein the sleeper unit is supported by side rails attached to arm members of the furniture.

Specifically, our invention comprises an easily assembled and disassembled upholstered furniture system for mounting on a substantially horizontal surface. It comprises first and second spaced apart substantially vertical arm members, each having an inner surface including back and front portions. First and second side support members are affixed to the inner surfaces of the first and second arm members respectively for removably and interchangeably supporting either a seat member or a sleeper unit.

First and second support elements are affixed to the back portions of the inner surfaces of the first and second arm members respectively, and a back member is interposed between the first and second spaced apart arm members. The back member includes an outer back part having first and second spaced apart vertical outer back part side members supported on the first and second support elements respectively, and a horizontal outer back part top rail extending between the first and second vertical outer back part side members. An inner back part is provided having first and second spaced apart vertical inner back part side members, and a horizontal inner back part top rail extending between the first and second vertical inner back part side members. A hinge connects the outer back part top rail to the inner back part top rail so as to permit rotation of the inner back part about a horizontal axis parallel to the outer and inner back part top rails.

Third and fourth support elements are affixed to the back portions of the inner surfaces of the first and second arm members respectively. The rotation of the inner back part about the horizontal axis brings the inner back part into contact with the third and fourth support elements thereby adjustably limiting rotation of the inner back part.

Fasteners are provided for removably fastening the back member to the first and second arm members, and a front member is interposed between the first and second spaced apart arm members. The front member is removably attached to the inner surfaces of the first and second arm members.

DESCRIPTION OF THE PREFERRED EMBODIMENTS

Figure 1:
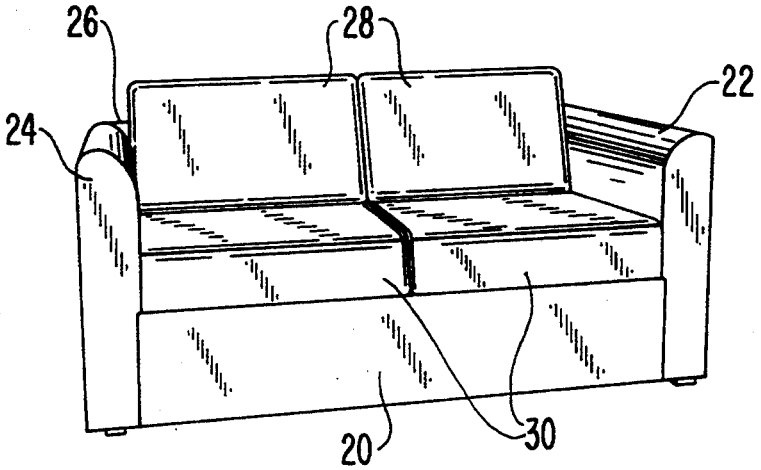
FIG. 1 is a perspective front view of an assembled upholstered sofa embodying the invention.

The following description describes sofas embodying the invention, but it will be understood that it is equally applicable to chairs and other types of upholstered furniture. In the description, the terms "vertical" and "horizontal" refer to the directions substantially perpendicular and parallel respectively to a floor on which the sofa or other type of furniture is placed. Also, the described sofa is symmetrical; therefore, for clarity some of the drawing figures show only the right-hand components as viewed from the front of the sofa, the left-hand components being mirror images of the right-hand components. In general, the right hand components are identified by unprimed numbers and the left-hand components, whether illustrated or not, are identified by primed numbers.

Figure 2:
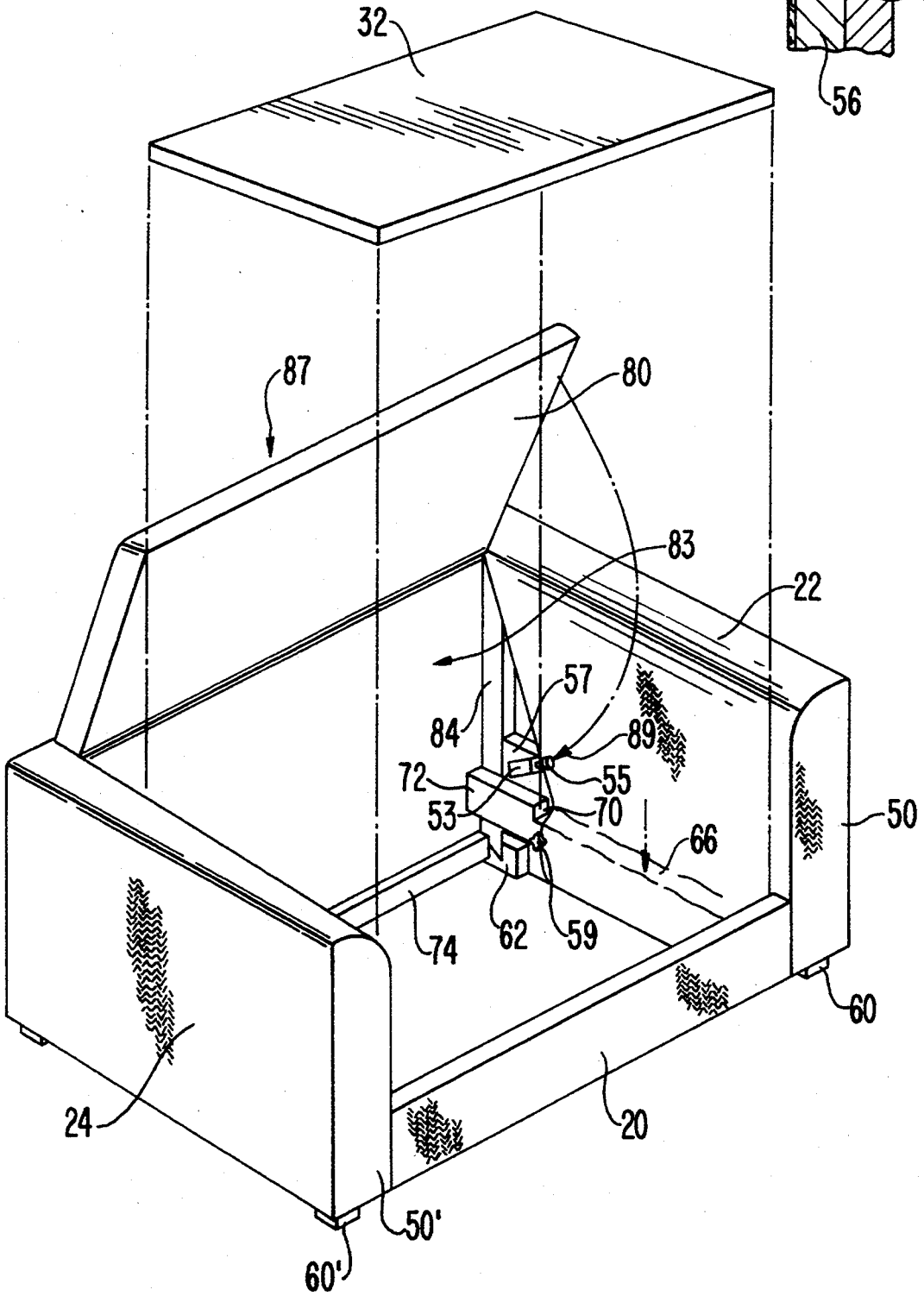
FIG. 2 is an exploded perspective view of the sofa of FIG. 1 partially disassembled to show how a spring platform is installed therein.
Figure 15:
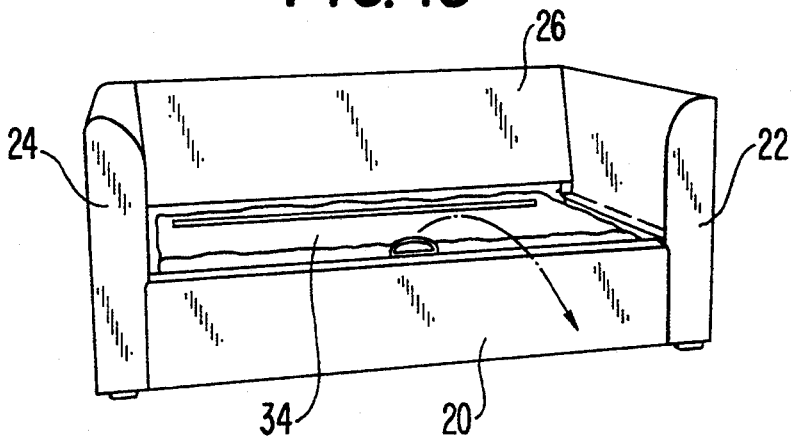
FIG. 15 is a front view of the sofa with the seat cushion and back cushion removed, and with the sleeper mechanism and mattress installed.
Figure 16:
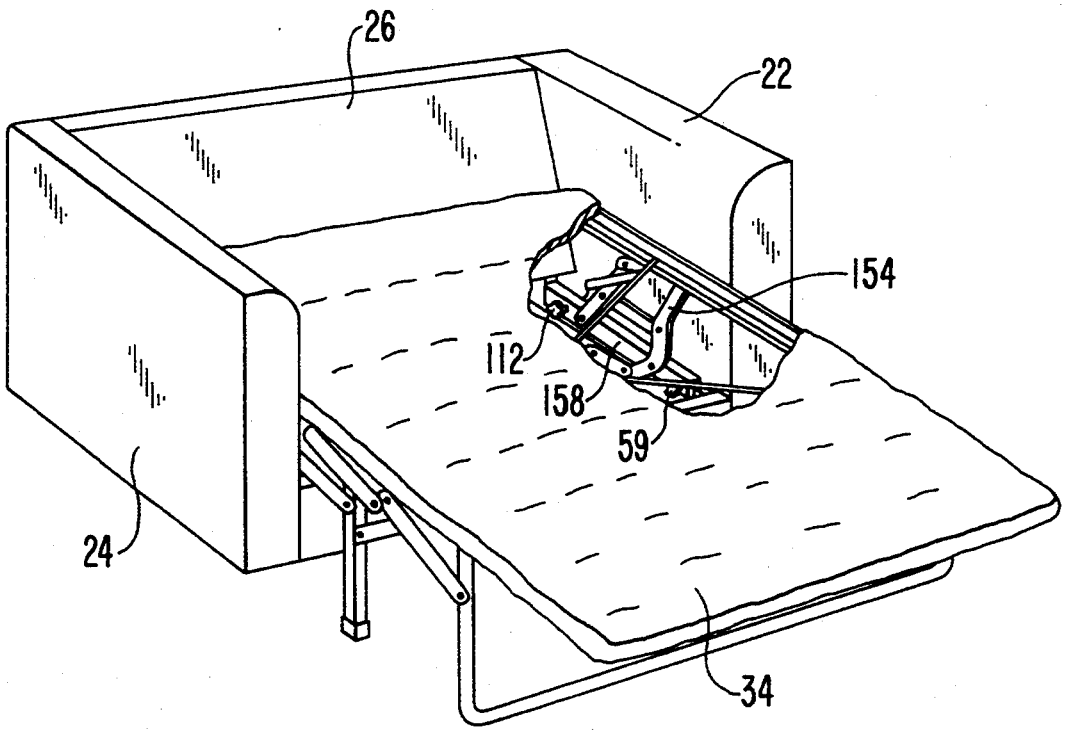
FIG. 16 is a perspective front view of the sofa with the sleeper mechanism and mattress unfolded.

FIG. 1 illustrates one embodiment of the assembled sofa of this invention, as viewed from the front thereof. The sofa comprises a vertical front member 20, a first or right-hand vertical arm member 22 and a second or left-hand vertical arm member 24 spaced apart from the right-hand member 22. A back member 26 is interposed between the arm members 22 and 24, and back cushions 28 and seat cushions 30 are provided. The back cushions 28 may alternatively be replaced by multiple smaller loose pillows or attached back cushions depending upon the style of the piece. The seat cushions 30 are supported by a seat support member which may be either a spring platform 32 (FIG. 2) or a modified sleeper unit or device including a mattress 34 (FIGS. 15 and 16). The spring platform may use coil springs, non-sag springs, webbing or any other seat support system utilized by conventional upholstered furniture. A sleeper device having a mechanism suitable for modification for use with this invention is manufactured by Leggett & Platt.

Figure 4:
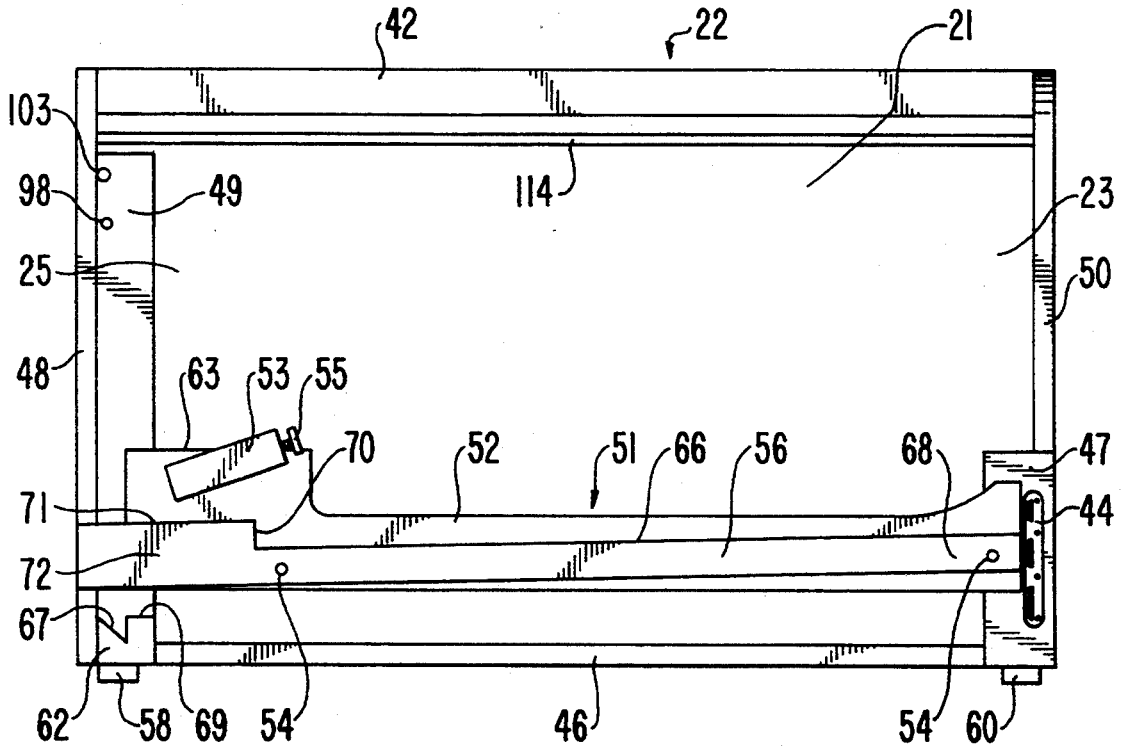
FIG. 4 illustrates the inside portion of the right arm of the sofa of FIG. 1.

Referring to FIG. 4, the arm member 22 comprises a horizontal bottom arm rail 46, back and front substantially vertical arm rails 48 and 50 attached to the inner surface 21 of member 22 adjacent the respective back and front portions 25 and 23 thereof, top horizontal rails 42 and 114, and vertical support members 47 and 49 joined to vertical arm rails 50 and 48 respectively. A side support section 51 comprising a horizontal side base plate 52, having a shelf portion 63, is attached to the inner surface 21 of arm member 22 via vertical support members 47 and 49, and a side support member 56 having a step portion 70 therein is attached to the side base plate 52. Legs 58 and 60 are attached to the bottom of horizontal bottom arm rail 46. The top surface 66 of the side support member 56 slopes downward with respect to a horizontal plane parallel to the floor from the front end 68 of member 56 to the step 70 adjacent the back end 72 of this member. Threaded inserts 54 are provided in the side support member 56 for supporting the locating bolts for attachment of the sleeper mechanism. The arm member 24 is identical and the mirror image of arm member 22.

Figure 9:
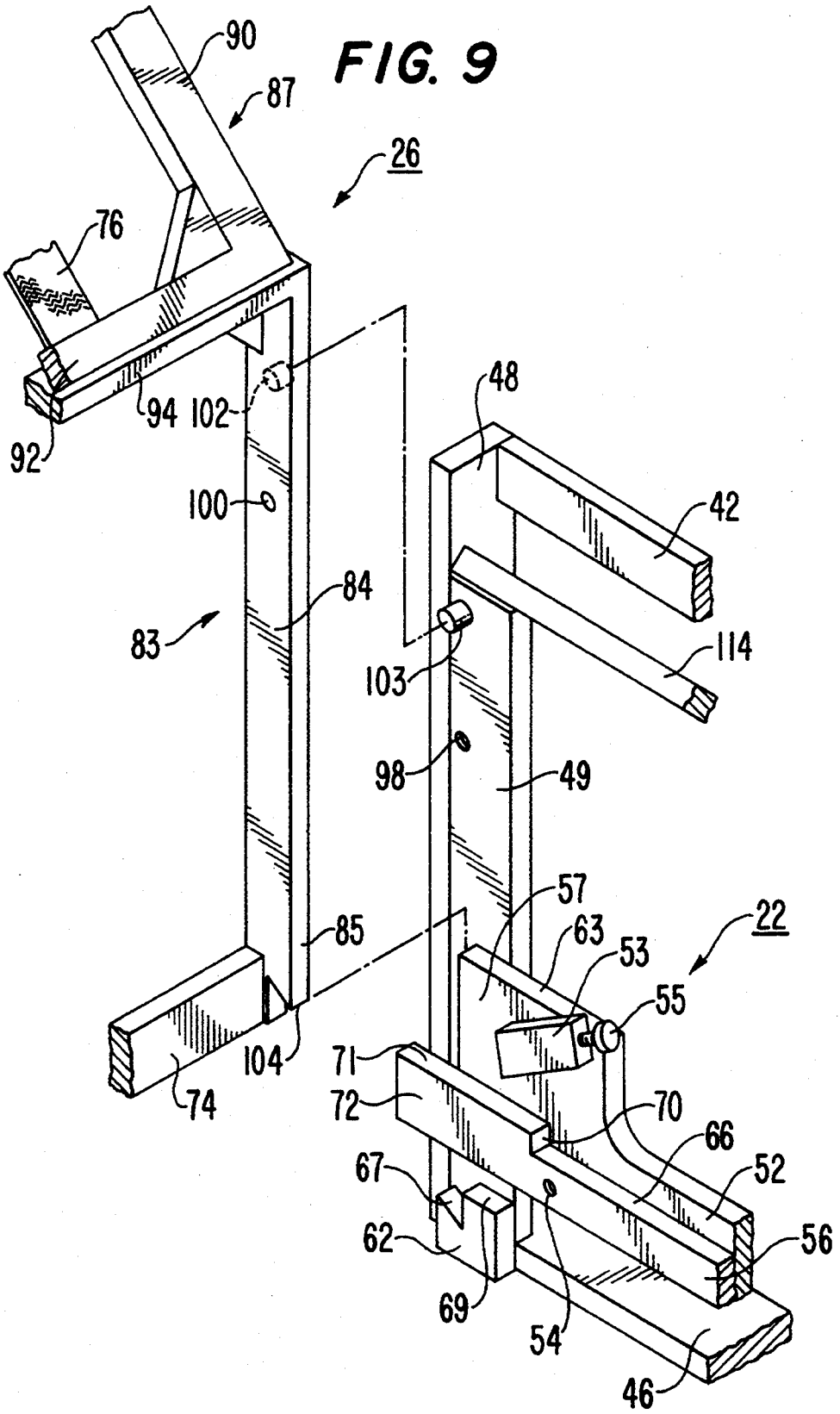
FIG. 9 is an exploded partial perspective view showing assembly of the right arm of the sofa to the back member thereof.

As illustrated in FIGS. 4 and 9, a first support element in the form of a block 62 is attached to the lower end of vertical support member 49 and bottom rail 46 of arm member 22, and a corresponding second support element in the form of a block 62' is attached to the lower end of back vertical support member 49' and bottom rail 46' of arm member 24. Block 62' element 49' and rail 46' are not shown in the drawings. A third support element 53 is attached to the upper part of the side base plate 52 adjacent the shelf portion 63 thereof, and a fourth support element 53' is attached to the upper part of the side base plate 52' adjacent the shelf portion 63'. Back support blocks 62, 62' are provided with notched portions 67, 67' in the tops 69, 69' thereof, and third and fourth support elements 53, 53' are provided with adjustable pitch control screws 55, 55' respectively for reasons to be explained hereinafter.

Figure 5:
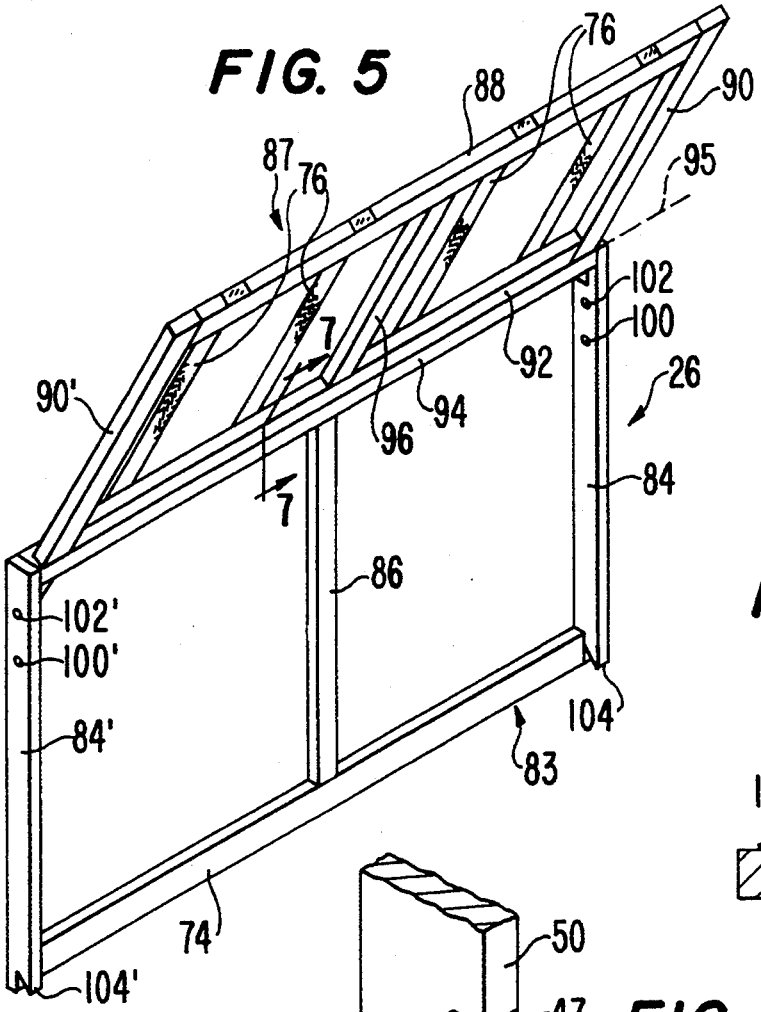
FIG. 5 is a perspective view of the back member of the sofa showing the inner and outer parts thereof.

Referring to FIG. 5, the back member 26 comprises an outer back part 83 and an inner back part 87. The outer back part 83 includes first and second spaced apart vertical side member or rails 84 and 84' respectively, a horizontal bottom rail 74, a horizontal top rail 94, and a vertical intermediate rail 86. The horizontal bottom and top rails 74 and 94 are interposed between the first and second side rail 84 and 84' and the intermediate rail 86 is centered between the bottom and top rails 74 and 94. The intermediate rail 86 is required for a sofa due to its length but would not usually be needed for a chair employing the invention. Longer sofas might require additional intermediate rails. The lower ends of the first and second outer back part side rails 84, 84' constitute wedge-shaped projections 104 and 104' which fit into the notched portions 67 and 67' in the tops 69, 69' of the blocks 62, 62' as will be explained.

The inner back part 87 includes first and second spaced apart vertical side members or rails 90 and 90' respectively, a horizontal bottom rail 88, a horizontal top rail 92, and a vertical intermediate rail 96. The horizontal bottom and top rails 88 and 92 are interposed between the first and second side rails 90 and 90' and the intermediate rail 96 is centered between the bottom and top rails 88 and 92. The intermediate rail 96 is required for a sofa due to its length but would not usually be needed for a chair employing the invention. Longer sofas might require additional intermediate rails. The total horizontal length of the inner back part 87 is not greater than the length of the horizontal top rail 94 of the outer back part 83 so that the inner back part 87 fits between the first and second spaced apart vertical side rails 84 and 84' of the outer back part 83. Elastic webbing 76 is stretched between the bottom rail 88 of the inner back part 87 and the top rail 94 of the outer back part 83, although springs may be used instead of webbing. The purpose of the elastic webbing is to assist the person assembling the sofa by holding inner back part 87 and outer back part 83 apart during assembly which allows easier access to means for assembling and disassembling the furniture. As inner back part 87 is lowered towards outer back part 83, a point is reached at which the webbing pulls inner back part 87 towards outer back part 83. This helps keep the two parts parallel and together for storage and shipping.

Figure 6:
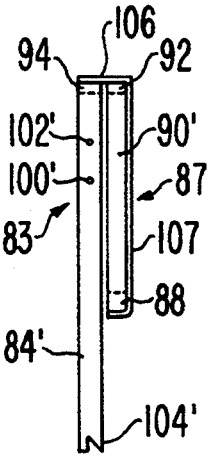
FIG. 6 illustrates how the inner and outer parts of the back member are connected by means of a hinge, with the inner member rotated to a position parallel to that of the outer member for shipping or storage.
Figure 7:
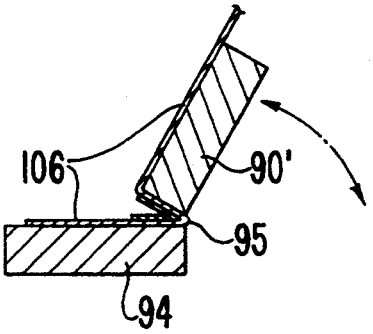
FIG. 7 illustrates how the inner and outer parts of the back member are connected by means of a hinge, with the inner member partially rotated to the position shown in FIG. 5.

As shown in FIGS. 6 and 7, a fabric hinge 106 extends along the lengths of the horizontal top rails 94 and 92 of the outer and inner back parts 83 and 87 respectively of the back member 26, and along the first and second side rails 90, 90' of the inner back part 87. The fabric hinge is secured to the rails 94, 92 by staples or some other suitable fastener and may be secured to the side rails 90, 90'. The hinge 106 can be made of fabric, plastic, metal or any other suitable material. Fabric hinge section 107 is extended over the front section of inner back member 87 to provide support for the back cushions 28. The outer back part 83 may be rotated about a horizontal axis 95 with respect to the inner back part 87 through almost 180 degrees, the position shown in FIG. 6 requiring minimum shipping and storage space for the back member 26.

Figure 10:
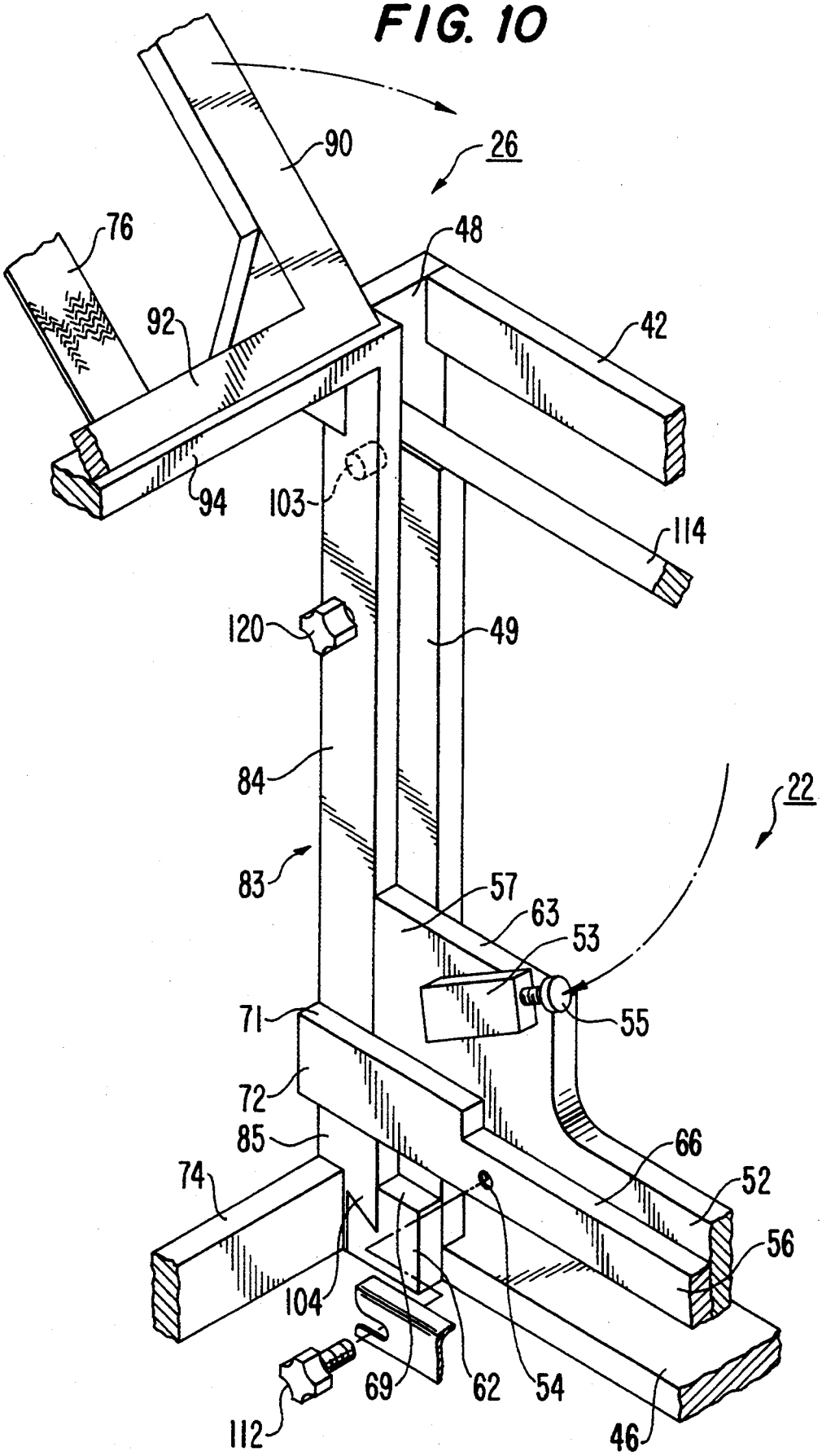
FIG. 10 is a partial perspective view showing the right arm of the sofa assembled to the back member thereof.

As shown in FIGS. 9 and 10, the back member 26 is removably attached to the vertical arm members 22 and 24 by inserting the outer back part side rails 84 and 84' between the back vertical arm rails 48 and 48' and the back ends 72, 72' of the side support members 56, 56' with the front edges 85, 85' of outer back part side rails 84, 84' butted against the rear ends 57, 57' of the horizontal side base plates 52, 52'. The wedge-shaped projections 104, 104' are inserted in the notched portions 67, 67' of the back support blocks 62, 62', and locator pins 103, 103' projecting from the back vertical arm rails 48 and 48' are inserted in locator pin reception holes 102, 102'. Thumbscrews 120, 120' are then inserted in holes 100, 100' and screwed into threaded inserts 98, 98' thereby securing the outer back member 83 to the arm members 22 and 24.

Figure 8:
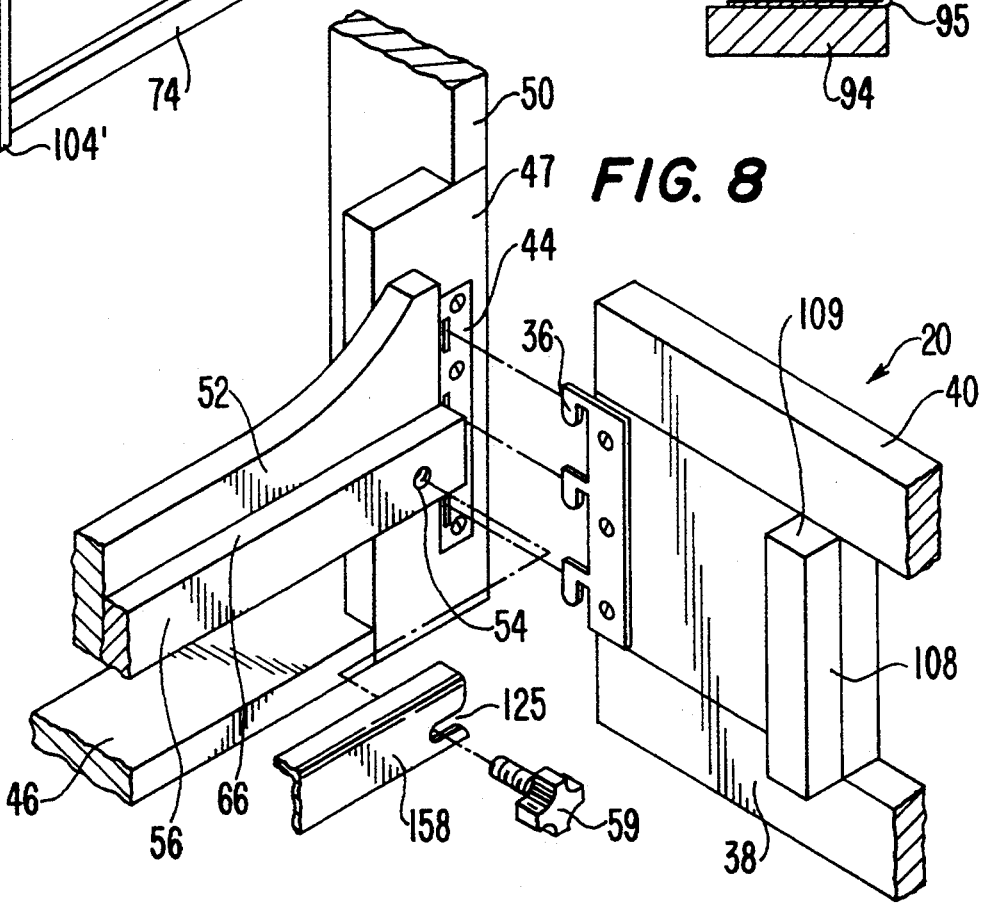
FIG. 8 is an exploded partial perspective view showing assembly of the right arm of the sofa to the front member thereof.

Referring to FIG. 8, the front member 20 consists of a wooden frame, preferably upholstered, having horizontal bottom and top front rails 38 and 40 respectively, and vertical stabilizer elements 108 interposed therebetween. The purpose of the vertical stabilizer elements is to lock the front member 20 in place when the sofa is assembled. One half 36 of a conventional three-pronged stamped metal fastener known as a bed hook is secured to an end of the front member 20 and the other half 44 is routed into or surface mounted onto the vertical support member 47 of the right arm member 22. Identical bed hook halves are attached to the other end of the front member 20 and to the vertical support member 47' of the left arm member 24. The bed hooks permit the front member 20 to be easily attached and detached from the arm members 22 and 24. If desired, a latching or locking device (not shown) may be attached to each end of the front member 20 and to the arm members 22, 24 below or above the bed hooks, although such a device is not usually required.

The spring platform 32 (FIG. 2) rests on the top portion 109 of vertical stabilizer elements 108 allowing the weight of the spring platform 32 to lock mating bed hook halves 36, 36' and 44, 44' into place. Disassembly is accomplished by first removing the spring platform before pulling up on front member 20.

After the back member 26 and front member 20 have been attached to the arm members 22 and 24, the inner back part 87 is rotated downward in the direction of arrow 89 (FIG. 2) until the inner surface 80 of the inner back part 87 comes into contact with the adjustable pitch control screws 55, 55' of third and fourth support elements 53, 53'. By adjusting the positions of the screws 55, 55' the angle between the inner back part 87 and the outer back part 83 can be altered to accommodate different types of back cushions 28. The screws 55, 55' can also be adjusted to make the sofa more comfortable for persons of different height, a taller person generally preferring that the screws be inserted further into the block than a shorter person who would usually be more comfortable with the screws withdrawn further from the block.

Besides providing a back member having an adjustable pitch and one which can be folded flat for storage or shipment, the invention permits easy access to the thumbscrews 120, 120' from either the front or rear without the use of flaps or zippers which can become unsightly and are relatively expensive.

Figure 17:
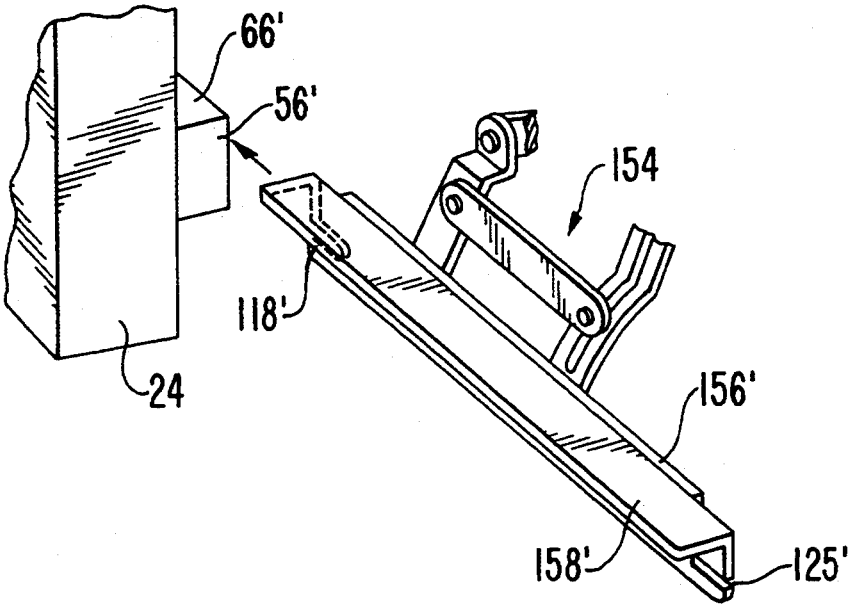
FIG. 17 is an exploded perspective view showing how the sleeper mechanism is supported by side support rails attached to the arms of the sofa.

As shown in FIGS. 16 and 17, a conventional sleeper mechanism 154 is modified by riveting or welding horizontal L-shaped brackets 158, 158' to horizontal attachment plates 156, 156' forming part of the sleeper mechanism 154. The brackets 158, 158' are provided with rear slots 118, 118' and front slots 125, 125'. The sleeper mechanism is installed by sliding the horizontal L brackets 158, 158' over the side support members 56, 56' to a position where the slots 118, 118' and 125, 125' are in registration with the threaded inserts 54, 54' (FIGS. 4,8,and 9) in the support members 56, 56'. Thumbscrews 59, 59' are then hand tightened into the inserts 54, 54' to fasten the sleeper mechanism 154 to the side support members 56, 56', as shown in FIGS. 8 and 16 Thumbscrews 112, 112' (FIGS. 10 and 16) are also provided. However, they are needed only to properly position the sleeper mechanism 154 the proper distance from front member 20. Thumbscrews 112, 112' could be replaced by less expensive bolts since thumbscrews 112, 112' are used for positioning only and do not need to be tightened into place. An advantage of this construction is that the sleeper mechanism 154 is supported by the side support members 56, 56' and not by bolts thereby providing a strengthened and more rigid structure.

Figure 3:
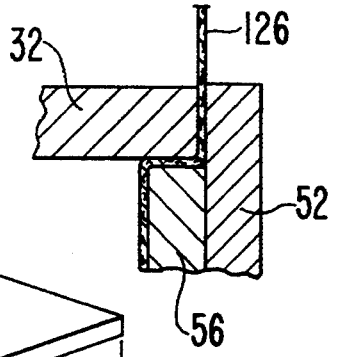
FIG. 3 shows how a removable cover is held in position by the spring platform.
Figure 11:
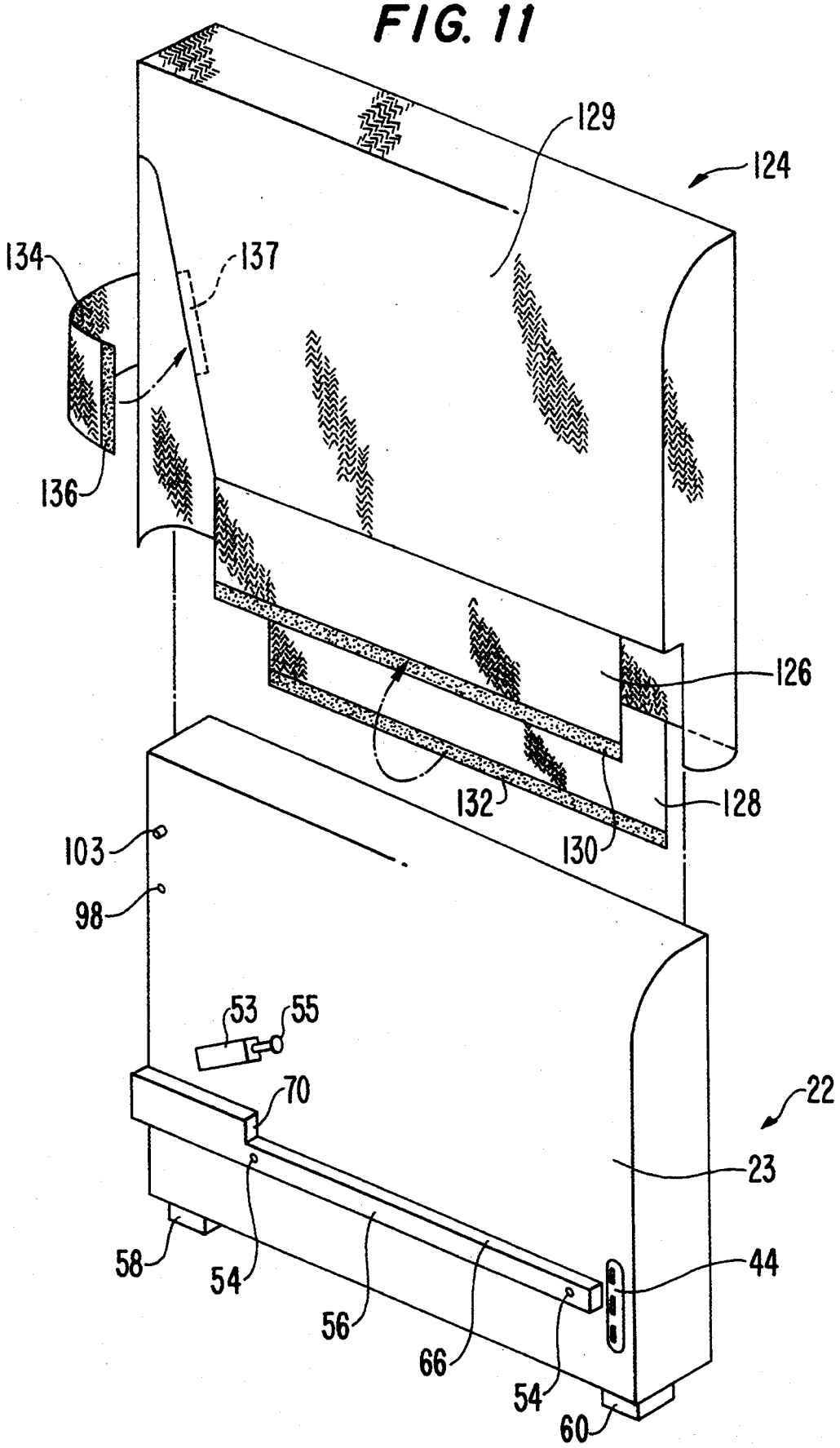
FIG. 11 is an exploded perspective view showing how a removable cover is attached to the right arm of the sofa of FIG. 1.
Figure 13:
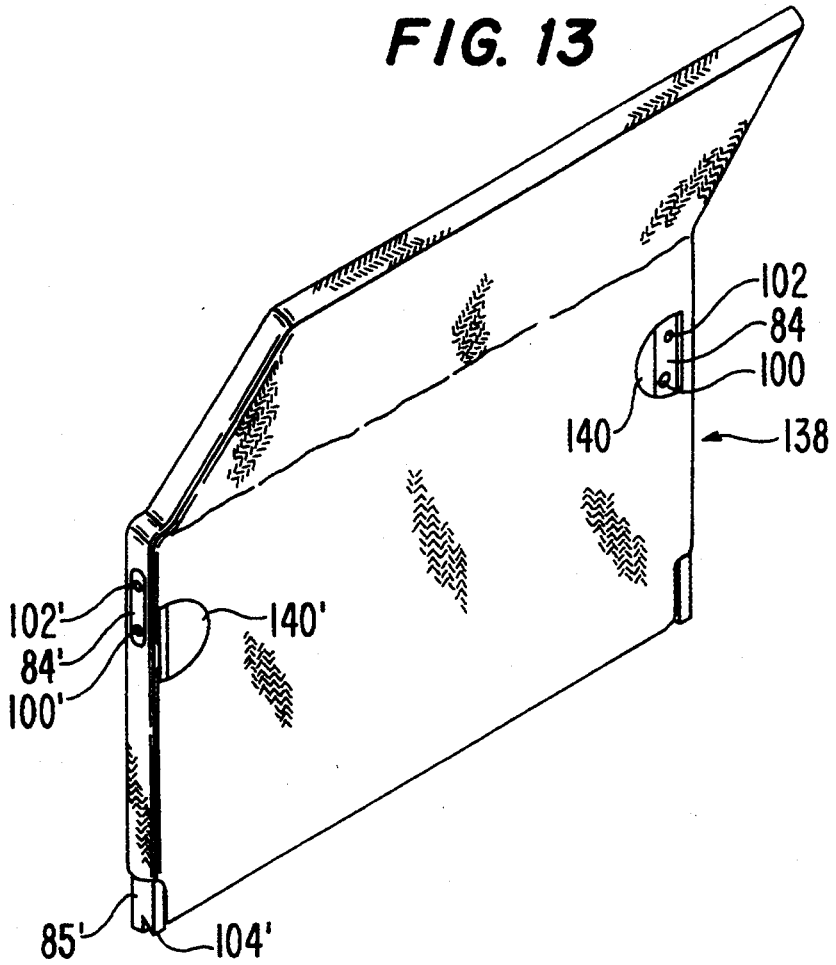
FIG. 13 is a perspective view showing the removable cover attached to the back member of the sofa.
Figure 14:
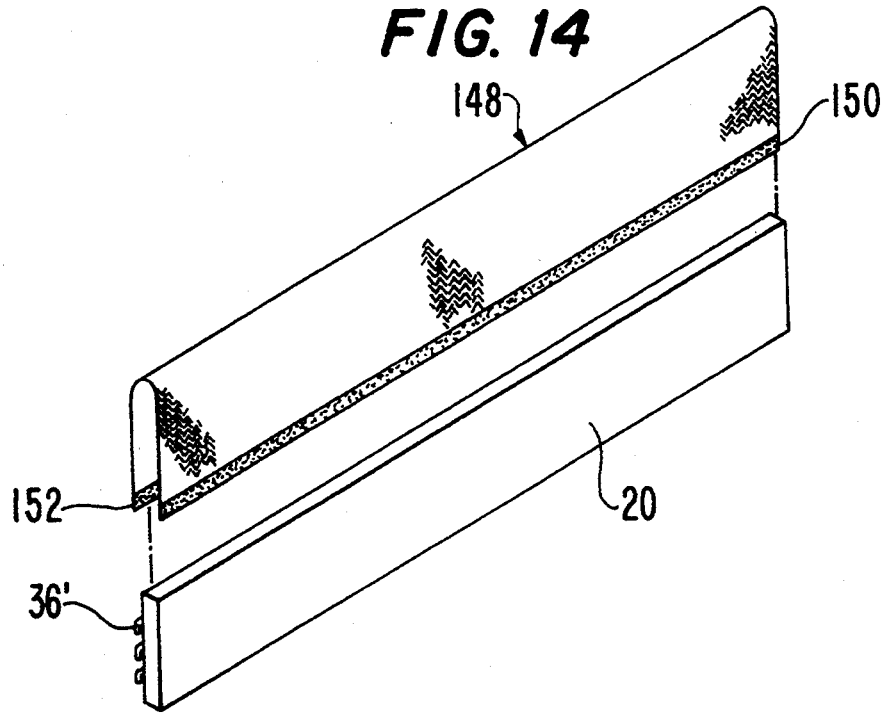
FIG. 14 is an exploded perspective view showing how a removable cover is attached to the front member of the sofa.

Removable covers can be placed on the arm members 22 and 24 as shown in FIG. 3 and 11, the back member 26 (FIGS. 12 and 13), and the front member (FIG. 14). Referring to FIG. 11, a removable cover 124 for arm 22 comprises inside and outside tabs 126 and 128 extending from the bottom of the upper part 129 of the cover 124. Hook and loop fastening strips 130 and 132 are attached to the lower ends of tabs 126 and 128. The tab 132 extends beneath the arm 22 and is attached to tab 130. The cover 124 is then pulled tightly into position in a vertical direction by the weight of the spring platform 32, as shown in FIG. 3, or by the weight of the sleeper mechanism L brackets 158, 158 resting on the top surfaces 66, 66' of side support members 56, 56'. The cover 124 is pulled tightly into position in a horizontal direction by extending tab 134 to attach hook and loop fastening strips 136, 137.

Figure 12:
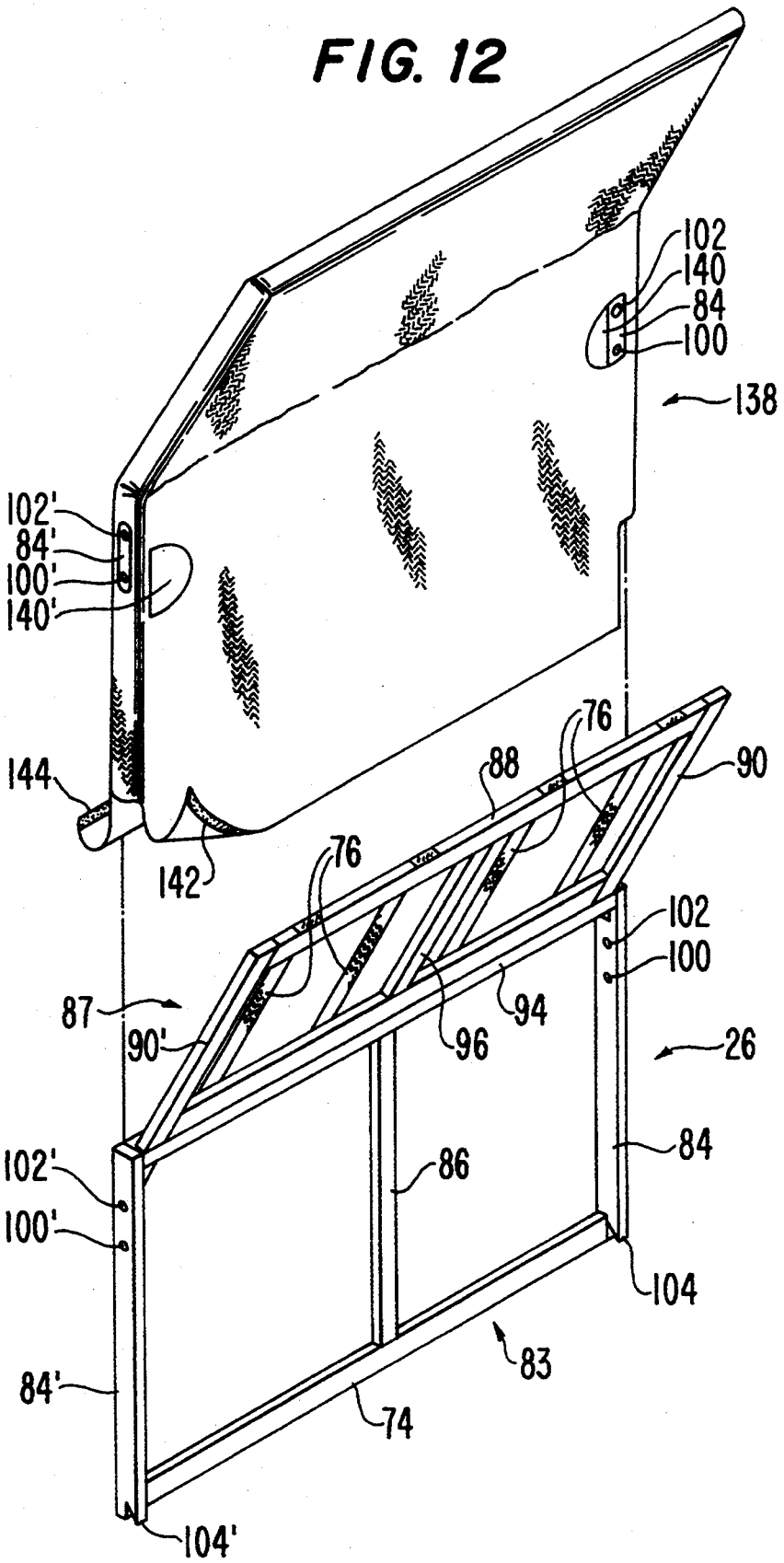
FIG. 12 is an exploded perspective view showing how a removable cover is attached to the back member of the sofa.

Referring to FIGS. 12 and 13, a removable cover 138 for the back member 26 of the sofa is slipped over the member 26 when the inner back part 87 is in an extended position, as shown in FIGS. 5 and 7. Hook and loop fasteners 142 and 144 are brought together to secure the cover 138 at the bottom of the back member 26. Access holes 140, 140' are cut in the removable cover 138 to permit reaching the thumbscrews 120, 120' when the cover is in place. As the inner back part 87 is lowered into the seating position at which it rests against pitch control screws 55, the cover 138 tightens into place.

With regard to the front member 20, a removable front cover 148 having hook and loop fasteners 150 and 152 is slipped over the member 20 and the fasteners 150 and 152 attached at the bottom of the member, as shown in FIG. 14.

Alternatively, removable covers 124, 124', 138 and 148 may be combined to form a single removable cover that covers the complete sofa.

Figure 18:
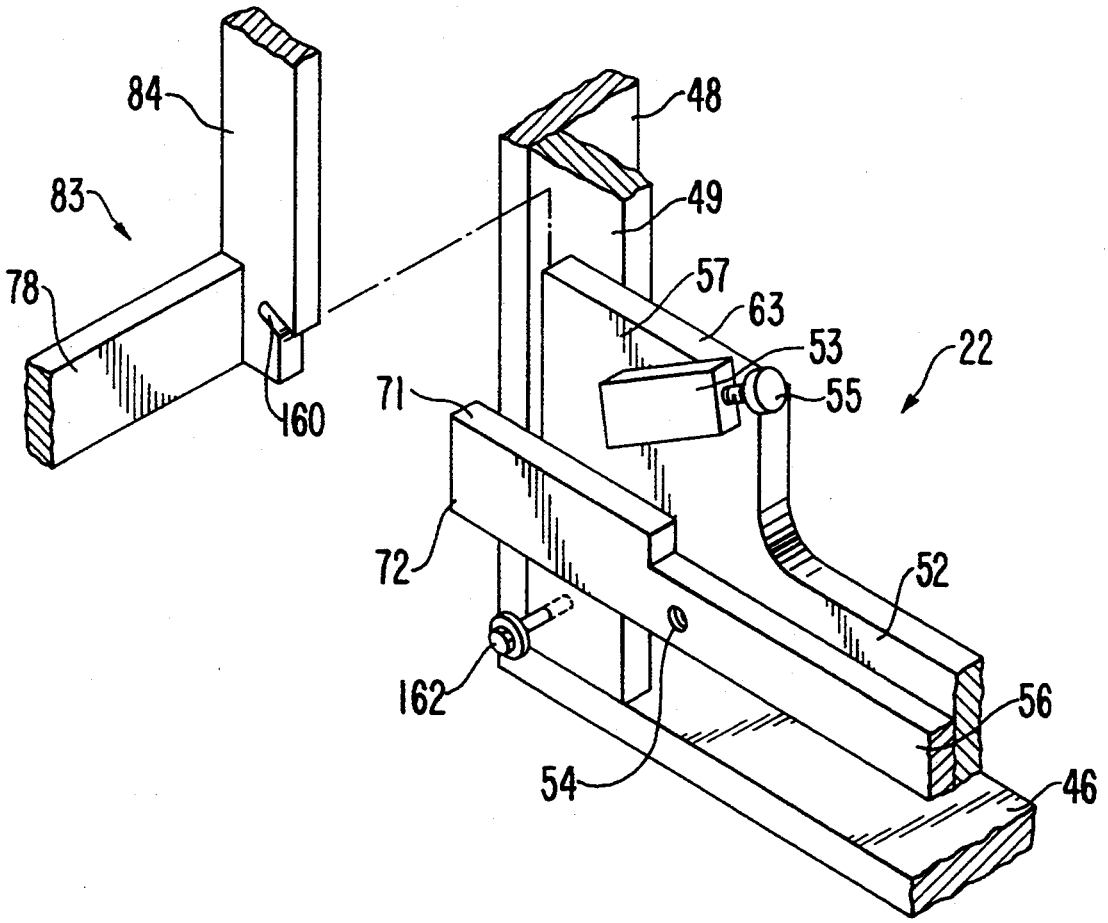
FIGS. 18 and 19 illustrate another embodiment of the invention wherein the back member is supported by bolts attached to the arm members.
Figure 19:
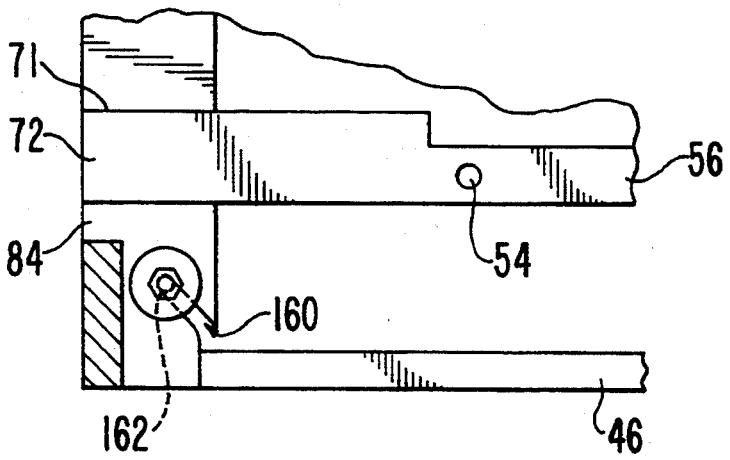

FIGS. 18 and 19 illustrate another embodiment of the invention wherein the first and second support elements are pins in the form of washer-headed bolts 162, 162' rather than blocks 62, 62'. In this form of the invention, slots 160, 160' are provided in the first and second side rails 84, 84' of the outer back part 83, and are located so as to slide over the shanks of the bolts 162, 162' between the washer-heads and the vertical support members 49, 49'. An advantage of this configuration over that shown in FIGS. 2, 4, 9 and 10 is that the insertion depth of the adjustable bolts 162, 162' can be changed by the manufacturer to accommodate different frame and fabric thicknesses.

While the present invention has been described in detail with respect to preferred embodiments, it will be understood that numerous modifications, changes, variations and equivalents may be made by those skilled in the art without departing from the spirit and scope of the invention. Accordingly, it is intended that the invention herein be limited only by the scope of the appended claims.

What is claimed:

1. An easily assembled and disassembled upholstered furniture system for mounting on a substantially horizontal surface, comprising first and second spaced apart substantially vertical arm members, each of said first and second arm members having an inner surface including back and front portions;

first and second side support members affixed to the inner surfaces of said first and second arm members respectively for removably supporting a seat support member;

first and second support elements affixed to the back portions of the inner surfaces of said first and second arm members respectively;

a back member interposed between said first and second spaced apart arm members, said back member including an outer back part having first and second spaced apart vertical outer back part side members supported by said first and second support elements respectively; and a horizontal outer back part top rail extending between said first and second vertical outer back part side members; and an inner back part having first and second spaced apart vertical inner back part side members; and a horizontal inner back part top rail extending between said first and second vertical inner back part side members; and hinge means connecting said outer back part top rail to said inner back part top rail, said hinge means permitting rotation of said inner back part about a horizontal axis parallel to said outer and inner back part top rails;

third and fourth support elements affixed to the back portions of the inner surfaces of said first and second arm members respectively, the rotation of said inner back part about said horizontal axis bringing said inner back part into contact with said third and fourth support elements thereby limiting rotation of said inner back part;

fastening means for removably fastening said back member to said first and second arm members; and a front member interposed between said first and second spaced apart arm members.

2. An upholstered furniture system as defined by claim 1 wherein pitch control screws project from said third and fourth support elements and are contacted by said inner back part after rotation about said horizontal axis, the angle between said inner and outer back parts being determined by the amount by which said pitch control screws project from said third and fourth support elements.

3. An upholstered furniture system as defined by claim 1 wherein said first and second support elements comprise blocks having notches in top surfaces thereof, and said first and second vertical outer back part side members have wedge-shaped projections which fit into the notches of said first and second support elements thereby supporting said first and second vertical outer back part side members.

4. An upholstered furniture system as defined by claim 1 wherein said first and second support elements comprise pins, and said first and second vertical outer back part side members are provided with slots therein, said slots fitting over said pins thereby supporting said first and second vertical outer back part side members.

5. An upholstered furniture system as defined by claim 1 wherein said seat support member is one of a spring platform and a sleeper unit.

6. An upholstered furniture system as defined by claim 5 wherein said sleeper unit is supported by said first and second side support members.

7. An upholstered furniture system as defined by claim 1 wherein said front member is removably attached to the inner surfaces of said first and second arm members.

8. An upholstered furniture system as defined by claim 1 which further comprises removable covers adapted for placement on said arm members, said cover being interposed between said first and second side support members and said seat support member, the weight of said seat support member holding said cover tightly in position.

9. An upholstered furniture system as defined by claim 8 wherein said seat support member is one of a spring platform and a sleeper unit.

10. An upholstered furniture system for mounting on a substantially horizontal surface, comprising first and second spaced apart substantially vertical arm members, each of said first and second arm members having an inner surface including back and front portions;

a back member interposed between said first and second spaced apart arm members;

fastening means for fastening said back member to said first and second arm members;

a front member interposed between said first and second spaced apart arm members;

first and second elongated side support members affixed to the inner surfaces of said first and second arm members respectively, each of said support members having a top surface extending between the front and back portions of the inner surfaces of said first and second arm members; and a sleeper mechanism having first and second elongated horizontal L-shaped brackets attached thereto, said first and second brackets being supported by the top surfaces of said first and second side support members respectively.

11. An upholstered furniture system as defined by claim 10 wherein said back member includes an outer back part having first and second spaced apart vertical outer back part side members supported by said first and second support elements respectively; and a horizontal outer back part top rail extending between said first and second vertical outer back part side members; and an inner back part having first and second spaced apart vertical inner back part side members; and a horizontal inner back part top rail extending between said first and second vertical inner back part side members; and hinge means connecting said outer back part top rail to said inner back part top rail, said hinge means permitting rotation of said inner back part about a horizontal axis parallel to said outer and inner back part top rails; and third and fourth support elements affixed to the back portions of the inner surfaces of said first and second arm members respectively, the rotation of said inner back part about said horizontal axis bringing said inner back part into contact with said third and fourth support elements thereby limiting rotation of said inner back part.

12. An upholstered furniture system as defined by claim 11 wherein pitch control screws project from said third and fourth support elements and are contacted by said inner back part after rotation about said horizontal axis, the angle between said inner and outer back parts being determined by the amount by which said pitch control screws project from said third and fourth support elements.

13. An upholstered furniture system as defined by claim 10 which further comprises first and second support elements affixed to the back portions of the inner surfaces of said first and second arm members respectively.

14. An upholstered furniture system as defined by claim 13 wherein said first and second support elements comprise pins, and said first and second vertical outer back part side members are provided with slots therein, said slots fitting over said pins thereby supporting said first and second vertical outer back part side members.

15. An upholstered furniture system as defined by claim 10 which further comprises removable covers adapted for placement on said arm members, said cover being interposed between said first and second side support members and said seat support member, the weight of said seat support member holding said cover tightly in position.

16. An easily assembled and disassembled upholstered furniture system for mounting on a substantially horizontal surface, comprising first and second spaced apart substantially vertical arm members, each of said first and second arm members having an inner surface including back and front portions;

first and second side support members affixed to the inner surfaces of said first and second arm members respectively, each of said side support members having a top surface;

first, second, third and fourth support elements affixed to the back portions of the inner surfaces of said first and second arm members, respectively;

a back member interposed between said first and second spaced apart arm members, said back member having an outer back part supported by said first and second support elements, an inner back part and a hinge connecting said outer back part to said inner back part, said hinge permitting rotation of said inner back part about a horizontal axis to bring said inner back part into contact with said third and fourth support elements thereby limiting rotation of said inner back part;

fastening means for removably fastening said back member to said first and second arm members; and a seat support member removably supported by the top surfaces of said first and second side support members.

17. An upholstered furniture system as defined by claim 16 wherein said seat support member is a sleeper mechanism having first and second horizontal brackets attached thereto, said first and second brackets being supported by the top surfaces of said first and second side support members respectively.

18. An upholstered furniture system as defined by claim 16 wherein said seat support member is a spring platform.

19. An easily assembled and disassembled upholstered furniture system for mounting on a substantially horizontal surface, comprising first and second spaced apart substantially vertical members, each of said first and second vertical members having back and front portions;

first and second side support members affixed to said first and second vertical members respectively for removably supporting a seat support member;

first and second support elements affixed to said first and second vertical members respectively;

a back member interposed between said first and second spaced apart vertical members, said back member including an outer back part supported by said first and second support elements;

an inner back part; and hinge means connecting said outer and inner back parts, said hinge means permitting rotation of said inner back part about a horizontal axis perpendicular to said first and second vertical members;

third and fourth support elements affixed to said first and second vertical members respectively, the rotation of said inner back part about said horizontal axis bringing said inner back part into contact with said third and fourth support elements thereby limiting rotation of said inner back part; and fastening means for removably fastening said back member to at least one of said first and second vertical members.

20. An easily assembled and disassembled upholstered furniture system for mounting on a substantially horizontal surface as defined by claim 19 which further comprises a sleeper mechanism having first and second horizontal brackets attached thereto, said first and second brackets being supported by the top surfaces of said first and second side support members respectively.

21. A furniture system for mounting on a substantially horizontal surface, comprising first and second spaced apart substantially vertical arm members, each of said first and second arm members having an inner surface including back and front portions;

a back member interposed between said first and second spaced apart arm members, said back member including an outer back part having first and second spaced apart vertical outer back part side members supported by said first and second support elements respectively; and a horizontal outer back part top rail extending between said first and second vertical outer back part side members; and an inner back part having first and second spaced apart vertical inner back part side members; and a horizontal inner back part top rail extending between said first and second vertical inner back part side members; and hinge means connecting said outer back part top rail to said inner back part top rail, said hinge means permitting rotation of said inner back part about a horizontal axis parallel to said outer and inner back part top rails; and third and fourth support elements affixed to the back portions of the inner surfaces of said first and second arm members respectively, the rotation of said inner back part about said horizontal axis bringing said inner back part into contact with said third and fourth support elements thereby limiting rotation of said inner back part;

fastening means for fastening said back member to said first and second arm members;

a front member interposed between said first and second spaced apart arm members;

first and second side support members affixed to the inner surfaces of said first and second arm members respectively, each of said support members having a top surface; and a sleeper mechanism having first and second horizontal L-shaped brackets attached thereto, said first and second brackets being supported by the top surfaces of said first and second side support members respectively.

22. A furniture system for mounting on a substantially horizontal surface, comprising first and second spaced apart substantially vertical arm members, each of said first and second vertical arm members having back and front portions;

first and second elongated side support members affixed to the inner surfaces of said first and second arm members respectively, each of said support members having a top surface extending between the front and back portions of the inner surfaces of said first and second arm members;

a sleeper mechanism having first and second elongated horizontal L-shaped brackets attached thereto, said first and second brackets being supported by the top surfaces of said first and second side support members respectively; and a back member interposed between said first and second spaced apart vertical members.

* * * * *